United States Patent [19]

Yoshino et al.

[11] Patent Number: 4,634,257

[45] Date of Patent: Jan. 6, 1987

[54] ELECTROSTATIC PRINTING METHOD

[75] Inventors: Masaki Yoshino; Kozo Oka; Fuminori Koide, all of Kanagawa, Japan

[73] Assignee: Fuji Xerox Co., Ltd., Tokyo, Japan

[21] Appl. No.: 660,543

[22] Filed: Oct. 12, 1984

Related U.S. Application Data

[63] Continuation of Ser. No. 413,098, Aug. 30, 1982, abandoned.

[30] Foreign Application Priority Data

Sep. 4, 1981 [JP] Japan ..... 56-138374

[51] Int. Cl.[4] ..... G03G 15/02

[52] U.S. Cl. ..... 355/3 CH; 355/77; 430/35; 430/902

[58] Field of Search ..... 355/3 CH, 14 CH, 3 R, 355/3 FU, 77; 430/35, 31, 902

[56] References Cited

U.S. PATENT DOCUMENTS

| | | | |
|---|---|---|---|
| 3,615,128 | 10/1971 | Bhagat | 355/3 R |
| 3,655,280 | 4/1972 | Zoppoth | 355/3 FU |
| 3,795,442 | 3/1974 | Kimura et al. | 355/3 R |
| 4,090,108 | 5/1978 | Johnson | 355/3 FU |
| 4,355,225 | 10/1982 | Marsh | 355/3 FU |

*Primary Examiner*—R. L. Moses

*Attorney, Agent, or Firm*—Sughrue, Mion, Zinn, Macpeak, and Seas

[57] ABSTRACT

An electrostatic printing method is disclosed which improves the print quality by using an infrared or a flash fixing method followed by a charge recovery step whereby the image region potential of the printing master is increased by subjecting the master to one or more charging cycles.

5 Claims, 3 Drawing Figures

ELECTROSTATIC PRINTING METHOD

This is a continuation of application Ser. No. 413,098, filed Aug. 30, 1982 now abandoned.

BACKGROUND OF THE INVENTION

Printing according to an electronic photographic system is well known in the art. For instance, the xerographic printing system disclosed by U.S. Pat. No. 2576047 and an electronic printing apparatus disclosed by Japanese Patent Application Publication No. 1554/1968 are well known in the art. In this prior art, a toner image is formed on a photo-conductive plate according to an electrostatic photographic method and is fixed, so that a non-photosensitive insulating pattern, namely, a printing master, is formed on the photo-conductive plate. In succession, the printing master is uniformly charged and is uniformly exposed to light, whereby the charges remain on only the image region which is not photo-sensitive while the charges are removed from the photo-sensitive region. Therefore, by applying charged toner to the plate which has been so partially charged, a toner image is formed thereon, which is then transferred onto a suitable image support. The above-described operation is repeatedly carried out to obtain prints. The aforementioned Japanese Patent Application No. 1554/1968 discloses an apparatus as shown in FIG. 1. In FIG. 1, reference numeral 1 designates a rotary drum which includes pawls on the cylindrical wall, to hold a photo-sensitive sheet 10. Provided around the drum 1 are a cleaning unit 8, a charging unit 4, a uniform exposure lamp 13, a developing unit 5, a transferring corotron 6 and an infrared fixing unit 7 for fixing the toner image on the photo-sensitive sheet 10.

The printing master is formed as follows: A photo-sensitive sheet 10, after being wound on the drum 1, is charged by the charging unit 4. The image of an original disposed on a platen 3 which is illuminated by an illuminating lamp 14 is projected onto the photo-sensitive sheet 10 by a projecting lens 2, so that an electrostatic latent image is formed therein. The latent image is developed by the developing unit 5, and the toner image is fixed on the photo-sensitive sheet 10 through fusion by the infrared fixing unit 7, to obtain the printing master.

A number of copies can be obtained from the printing master by electrostatic printing as follows: The printing master having the toner image on the photo-sensitive sheet is charged by the charging unit 4 and is then uniformly exposed to light by the exposure lamp 13. The charges on the uniformly charged photo-sensitive sheet 10 are selectively caused to be drawn off by the uniform exposure with the exception of those on the toner image region which is not photo-sensitive nor photo-conductive. Thus, a printing master having charges on the toner image only is formed. The printing master thus formed is developed by the developing unit 5. The transferring sheet 11 is delivered to the transferring section in synchronization with the rotation of the drum 1. The toner image on the printing master is transferred onto the transferring sheet by the transferring corotron 6 and the image thus transferred is fixed by the fixing unit 9. Thereafter, the sheet is discharged into a sheet discharging tray, to thus obtain a copy of the printing master.

The toner remaining on the printing master after printing is removed by the cleaning unit 8 to complete one printing cycle. The printing cycle as described above is repeatedly carried out as many times as the required number of copies.

In the above-described method, the infrared fixing unit 7 is used to fix the toner image on the photo-sensitive sheet 10 in the course of forming the printing master. The present inventors have compared this method with other fixing methods by measuring the potentials at image regions on the printing masters thereof. The comparative results are as indicated in Table 1 below:

TABLE 1

| Kind of fixing unit | Potential at image region |
|---|---|
| Infrared fixing unit | −50 V |
| Flash fixing unit | −100 V |
| Hot roll fixing unit | −540 V |
| Pressure roll fixing unit | −500 V |

As is apparent from Table 1, the decrease of the potential at the image region when fixing is carried out with the infrared fixing unit or the flash fixing unit is larger than that of the potential at the image region when fixing is carried out with the hot roll fixing unit or the pressure roll fixing unit. Thus, the hot roll fixing method or the pressure roll fixing method may be employed as a fixing method in the formation of a printing master and can maintain a sufficiently high potential at the image region thereof. However, in either the hot roll or pressure roll fixing methods, after being peeled from the drum 1, the photo-sensitive sheet on which the toner image has been formed is delivered through a guide to the fixing unit, to be subjected to fixing. Then, the photo-sensitive sheet thus treated is delivered back to the drum 1, so that it is again supported on the drum 1. That is, the hot roll fixing method and the pressure roll fixing method are disadvantageous in that they require intricate, expensive auxiliary techiques.

SUMMARY OF THE INVENTION

Accordingly, an object of this invention is to provide an electrostatic printing method in which the potential at an image region can be obtained at a sufficiently high valve even when the infrared fixing unit or the flash fixing unit is used to fix the toner image on a photo-sensitive sheet.

According to the invention, after the toner image on a photo-sensitive sheet is fixed by an infrared fixing unit or a flash fixing unit, to form a printing master the printing sheet formed is repeatedly charged before the printing step, to thereby recover the chargeability of the photo-conductive layer corresponding to the image region of the printing master. The printing master thereby formed can then be employed to form multiple copies in the same manner as in the conventional printing process.

DETAILED DESCRIPTION OF THE PREFERRED EMBODIMENTS

Figure 1:
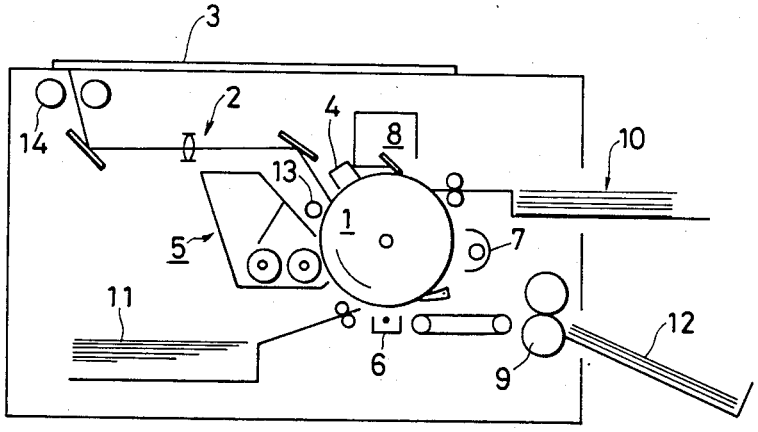
FIG. 1 is a sectional view outlining the arrangement of an electronic printing apparatus.

This invention will now be described with reference to FIG. 1.

Figure 2:
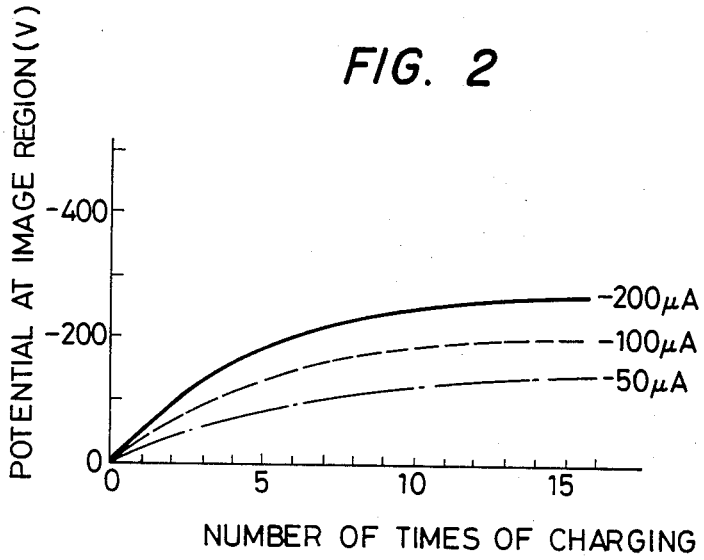
FIGS. 2 and 3 are graphical representations showing the chargeability recovery characteristics of printing masters according to this invention.

The photo-conductive sheet 10 is wound on the drum 1 and is then charged by the charging unit 4. The image of the original is formed on the sheet by the projecting lens 2, to that an electrostatic latent image is formed in the photo-conductive sheet 10. Then, the latent image is developed by the developing unit 5, and the toner image on the photo-conductive sheet 10 is fixed by the infrared fixing unit 7. In this condition, the potential at the image region is too low to carry out the ensuing printing operation. However, the chargeability of the toner image region of the photo-conductive sheet can be recovered by repeatedly carrying out a step in which the charging unit 4 is operated while the drum 1 is rotated. In this operation, it is desirable that the developing unit is not operated. FIG. 2 shows the results of the step of recovering the chargeability to thus form the printing master.

It has been found that the characteristic of the recovery of the image region potential depends on the number of charging cycles and the current value of the charging unit employed, as indicated in FIG. 2.

Figure 3:
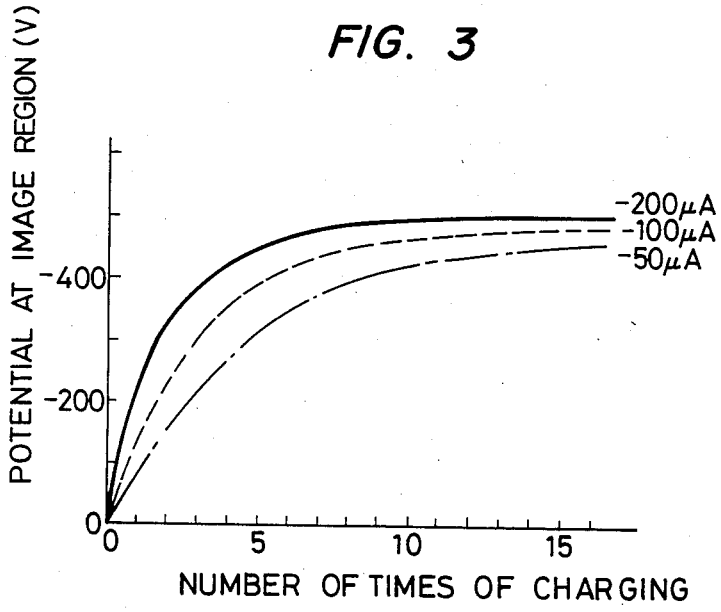

The above-described step has also been carried out using a flash fixing unit. The results are as shown in FIG. 3. As is apparent from a comparison of FIGS. 2 and 3, the charge recovery characteristic with the use of the flash fixing unit is better than that when the infrared fixing unit is used.

According to the invention, after a toner image is formed on a photo-conductive sheet according to an electrostatic photographic method and is fixed with an infrared fixing unit or a flash fixing unit, a chargeability recovery step in which the photosensitive sheet is repeatedly charged in inserted before the printing operation is carried out, whereby a printed image of sufficiently high density and excellent picture quality can be obtained.

In the charge recovery step for recovering the image region potential of the photosensitve sheet according to the invention, the charging operation is carried out using the charging unit with the printing sheet being maintained wound on the rotating drum. The photosensitive sheet can be charged as required by selecting a suitable number of charging cycles and a suitable charging current intensity. In general, the intensity of the charging current from the charging unit is from 0.01 to 1 $mA/cm^2$, and the number of charging cycles (or the number of revolutions of the drum) is from 1 to 50.

The invention will be described in more detail with reference to the following example.

EXAMPLE

A printing master was prepared by forming a latent image on a photo-sensitive sheet according to the electrostatic photographic method, after which the latent image was developed and fixed by performing a flash operation with an energy of 3 $J/cm^2$. The image region potential of the photosensitive sheet thus prepared was −150 V. Under the conditions that the processing speed was 400 mm/sec, the voltage applied by the charging unit was −7 kV and the value of the current applied to the photo-sensitive sheet was −200 μA, the photosensitive sheet was charged while turning the drum. After the drum made seven revolutions, the image region potential of the printing master thereby formed reached a desired value of −400 V. Prints of excellent picture quality could be obtained using the printing master in the following printing step.

What is claimed is:

1. A method of electrostatic printing, comprising the steps of:

forming a printing master by forming a fixed toner image on a photoconductive member, and then charging said photoconductive member by effecting a plurality of like charging operations on said photoconductive member to thereby increase a potential in an image region thereof; and printing a least one copy from said printing master by charging said printing master with a single charging operation, uniformly illuminating said charged printing master, developing said illuminated printing master, and transferring a toner image from said developed printing master onto a transferring sheet for obtaining a print.

2. The method of electrostatic printing of claim 1, wherein said step of forming said fixed toner image comprises a step of infrared fixing.

3. The method of electrostatic printing of claim 1, wherein said step of forming said fixed toner image comprises a step of flash fixing.

4. The method of electrostatic printing of claim 1, wherein said step of charging said photoconductive member comprises steps of disposing said photoconductive member on a drum disposed proximate a charging unit, and rotating said drum through a plurality of rotations.

5. The method of electrostatic printing of claim 1, wherein said step of charging said photoconductive member comprises steps of disposing said photoconductive member on a drum disposed proximate a charging unit, and operating said charging unit while rotating said drum through a plurality of rotations until an image region potential of said member reaches a desired value.

* * * * *